US007493787B2

(12) United States Patent
Golovashchenko et al.

(10) Patent No.: US 7,493,787 B2
(45) Date of Patent: Feb. 24, 2009

(54) ELECTRO-HYDRAULIC FORMING TOOL HAVING TWO LIQUID VOLUMES SEPARATED BY A MEMBRANE

(75) Inventors: Sergey Golovashchenko, Beverly Hills, MI (US); Vyacheslav Mamutov, St. Petersburg (RU); Andrey Ilinich, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 302 days.

(21) Appl. No.: 11/609,053

(22) Filed: Dec. 11, 2006

(65) Prior Publication Data

US 2008/0134741 A1 Jun. 12, 2008

(51) Int. Cl.
*B21D 26/12* (2006.01)
*B21D 22/12* (2006.01)

(52) U.S. Cl. ..... 72/63; 72/56; 29/421.1

(58) Field of Classification Search ..... 72/56, 72/57, 63; 29/421.1
See application file for complete search history.

(56) References Cited

U.S. PATENT DOCUMENTS

| | | | | |
|---|---|---|---|---|
| 3,222,902 | A * | 12/1965 | Brejcha et al. | 72/56 |
| 3,232,086 | A | 2/1966 | Inoue | |
| 3,394,569 | A | 7/1968 | Smith | |
| 3,423,979 | A | 1/1969 | Smith et al. | |
| 3,512,384 | A | 5/1970 | Inoue | |
| 3,566,645 | A | 3/1971 | Lemelson | |
| 3,593,551 | A | 7/1971 | Roth | |
| 3,742,746 | A * | 7/1973 | Erlandson | 72/56 |
| 4,392,368 | A * | 7/1983 | Folkesson et al. | 72/63 |
| 6,513,359 | B1 * | 2/2003 | Binder et al. | 72/57 |
| 6,591,649 | B1 * | 7/2003 | Gafri et al. | 72/56 |

FOREIGN PATENT DOCUMENTS

| | | |
|---|---|---|
| RU | 2158644 | 11/2000 |

OTHER PUBLICATIONS

Schrom E.C. "Metal Forming with Capacitor Discharge Electro-Spark", Paper SP62-80, published in Advanced High Energy Rate Forming. Book II, ASTME, 1962.

Kegg R.L. et al., "Research in Electric Discharge Forming Metals", Paper SP62-78 published in Advanced High Energy Rate Forming. Book II, ASTME, 1962.

S.F. Golovashchenko et al., "Formability of Sheet Metal with Pulsed Electromagnetic and Electrohydraulic Technologies", Proceedings of TMS Symposium "Aluminum-2003", San Diego, 2003.

(Continued)

*Primary Examiner*—David B Jones
(74) *Attorney, Agent, or Firm*—Raymond Coppiellie; Brooks Kushman P.C.

(57) ABSTRACT

An electro-hydraulic forming tool is disclosed in which a membrane is retained between two volumes of liquid that are separated by a membrane. Electrodes are provided with a high voltage impulse to create a shockwave in one of the volumes of fluid that is transferred through the membrane to the other volume of fluid. The shockwave is transmitted to a blank that is formed into a one-sided die. The blank is formed against the forming surface of the die. Air evacuation means are provided to remove air from the upper surface of one or both volumes of liquid.

20 Claims, 4 Drawing Sheets

OTHER PUBLICATIONS

J. Imbert et al., "The Effect of Tool/Sheet Interaction in Damage Evolution of Electromagnetic forming of Aluminum Alloy Sheet", Transactiosn ASME, Journal of Engineering Materials and Technology, 2005, N1.

J.G. Scrotch, "General Motors' Quick Plastic Forming Process", Advances in Superplasticity and Superplastic Forming TMS, 2004, pp. 9-20.

Guliy, G.A. et al., "Equipment and Technological Processes Employing Electrohydraulic Effect" Moscow: Mechanical Engineering, 1977.

L.A. Yutkin, "Electrohydraulic Effect and Some Potential Applications", St. Petersburg, 1959.

"Electrohydropulsed Treatment of Materials in Mechanical Engineering" Minsk: Science and Engineering, 1987.

Concurred: Project Leader of MSTC Project N 1593—Mar. 31, 2003 "Technical Report on Scientific Research Project: Development of the Technology of Static-Electrohydropulsed Drawing on the Punch of Parts of Boxed Shape", Town of Sarov, 2003.

* cited by examiner

ELECTRO-HYDRAULIC FORMING TOOL HAVING TWO LIQUID VOLUMES SEPARATED BY A MEMBRANE

BACKGROUND OF THE INVENTION

1. Field of the Invention

The present invention relates to an electro-hydraulic forming tool and a method of forming a sheet metal blank in an electro-hydraulic forming operation.

2. Background Art

Electro-hydraulic forming tools and processes produce a shockwave by creating a high voltage discharge in a liquid that is in contact with the sheet metal blank to be formed. The shockwave in the liquid is propagated towards the blank and causes the blank to be deformed into an open die that has a forming surface. The shockwave forces the blank into engagement with the forming surface to form the metal blank into the desired shape.

Prior art electro-hydraulic forming tools have a liquid containing vessel that has an opening on its lower end. A blank holder is provided to hold a blank into engagement with the lower end of the vessel. By providing the vessel on top of the blank, air bubbles do not tend to form on the blank that could interfere with the forming process. Any air bubbles on the surface of the blank at the time the shockwave is propagated may cause surface defects in the formed part.

One disadvantage of electro-hydraulic forming is that each discharge of the electrodes to create the high voltage discharge in the fluid results in the formation of impurities in the water that results in vaporization of the electrodes. The impurities in the fluid may be projected by the shockwave toward the blank and may create surface defects in the surface of the part formed in the process.

Another disadvantage of conventional electro-hydraulic forming tools is that the fluid in the vessel generally must be drained and replaced for each tool cycle. The volume of fluid in the vessel for a larger part tends to be fairly substantial and a considerable portion of the cycle time of the tool is dedicated to draining and refilling the vessel.

Prior art electro-hydraulic forming tools generally have only one pair of electrodes that are energized to allow forming a part in a single step. Some prior art electro-hydraulic forming tools, such as that disclosed in U.S. Pat. No. 3,232,086 to Inoue and U.S. Pat. No. 3,566,645 to Lemelson disclose the concept of providing multiple sets of contacts in a vessel of an electro-hydraulic forming tool. Both of these patents provide multiple electrodes in a single chamber of a vessel. Regardless of which electrode is energized, it is not possible to direct the forming force toward a particular part of the blank or otherwise provide a staged forming process.

In electro-hydraulic forming operations in which water contained in the vessel directly contacts the blank, the panel may flash rust if not immediately treated. Further, it is difficult to control the fluid in the vessel since the only closure member provided is the blank that is to be formed in the process.

In a bladder press, a membrane is provided that separates a blank from a liquid and undergoes the same deformation as the blank itself. The membrane is subject to considerable deformation that is substantially equal to the deformation of the blank that is formed. Substantial friction is created between the membrane of the bladder press and the blank.

The above problems and others are addressed by Applicants' invention as summarized below.

SUMMARY OF THE INVENTION

According to one embodiment, an electro-hydraulic forming tool is provided for forming a sheet metal blank. The tool comprises a vessel that defines a cavity containing a first liquid and that has at least two electrodes disposed in the first liquid. The vessel has an opening in an upper end. A forming die is disposed above the opening in the vessel and has a cavity that is partially defined by a forming surface. A blank holder holds the blank in engagement with the forming die. A membrane is attached to the vessel and the blank holder so that a second cavity is defined by the blank, the blank holder and the membrane. A second liquid is supplied to the second cavity on top of the membrane and below the blank. The membrane separates the first liquid in the vessel from the second liquid that forms the blank. A source of high voltage is operatively connected to the two electrodes by a control circuit that selectively provides a high voltage discharge to the electrodes. The high voltage discharge produces a shockwave in the first liquid that passes through the membrane and through the second liquid to form the blank against the forming surface in the cavity.

The above described electro-hydraulic forming tool minimizes the friction applied to the blank because the liquid engages the blank instead of the membrane. In addition, the membrane undergoes only relatively minor deformation of compared to the membrane in prior art bladder presses. In this case, the membrane deforms in a smooth shape as a result of pressure applied from both first and second liquids, which is expected to increase membrane life and minimize the production cycle interruptions.

Another embodiment comprises an electro-hydraulic forming tool for forming a sheet metal blank. The tool may comprise a vessel defining a first cavity containing a first liquid having at least two electrodes disposed in the first liquid with an opening being formed on the lower end of the vessel. A forming die is disposed below the opening in the vessel and has a cavity that is partially defined by a forming surface. A blank holder holds the blank in engagement with the forming die. A membrane is attached to the vessel and the blank holder so that a second cavity is defined by the blank, the blank holder and the membrane. A second liquid is supplied to the second cavity below the membrane above the blank wherein the membrane separates the first liquid in the vessel from the second liquid. A high voltage source is operatively connected to the two electrodes by a control circuit that selectively discharges high voltage to the electrodes. The high voltage discharge produces a shockwave in the first liquid that passes through the membrane and through the second liquid to form the blank against the forming surface in the cavity.

Other features of the electro-hydraulic forming tool may comprise a vessel vacuum port that opens into the vessel adjacent to the opening in the vessel and is ported to a source of vacuum. Proper air evacuation provides significant improvement of pressure transmitting efficiency from the discharge area to the blank surface. A vacuum port may also be provided that extends through the second cavity and opens into the blank holder just below the blank that is also ported to a source of vacuum. A forming die vacuum port may also be provided that opens into the forming die adjacent to the top of the forming surface. A lower liquid supply port may be provided in the vessel for supplying or removing liquid from the vessel. An upper liquid supply port is provided in the blank holder for supplying and removing liquid from the second cavity.

A method of forming a sheet metal blank in an electro-hydraulic forming tool is also provided. The method utilizes an electro-hydraulic forming tool that includes a vessel defining a first cavity containing a first liquid and at least two electrodes that are disposed in the first liquid. A forming die is provided that has a first cavity that is partially defined by a forming surface. A blank holder is provided that holds the blank in engagement with the forming die. A membrane is attached to the vessel and a blank holder so that a second cavity is defined by the blank, the blank holder and the membrane. A second liquid is supplied to the second cavity with the membrane separating in the first liquid in the vessel from the second liquid in the second cavity. A high voltage source is operatively connected to the two electrodes by a control circuit. According to the method, a high voltage discharge is provided to the electrodes that produces a shockwave in the first liquid. The shockwave is transferred through the membrane and passes through the second liquid. The shockwave is directed through the second liquid to the blank and results in the blank being formed towards the forming surface in the cavity.

Other features relating to the method may further comprise evacuating air from the first cavity and from the second cavity and filling the first and second cavities completely with the first and second liquids. Multiple chambers may be provided in the vessel that each are provided with a pair of electrodes so that the step of providing a high voltage discharge is performed by sequentially providing the high voltage discharge to each of the pairs of electrodes. The membrane is an elastic membrane that seals the first liquid in the first cavity from the second liquid in the second cavity. The first liquid may be water and the second liquid may be oil, water, or water with rust inhibiting additives. The steps of the method may be repeated at least once to form the blank fully into engagement with the forming surface. The second liquid may be drained completely or partially up to the lowest level of the blank from the second cavity and replenished each time the method is to be performed, while the first liquid is permitted to remain within the vessel.

These and other aspects of the present invention will be better understood in view of the attached drawings and the following detailed description of the preferred embodiments.

DETAILED DESCRIPTION OF THE PREFERRED EMBODIMENT(S)

Figure 1:
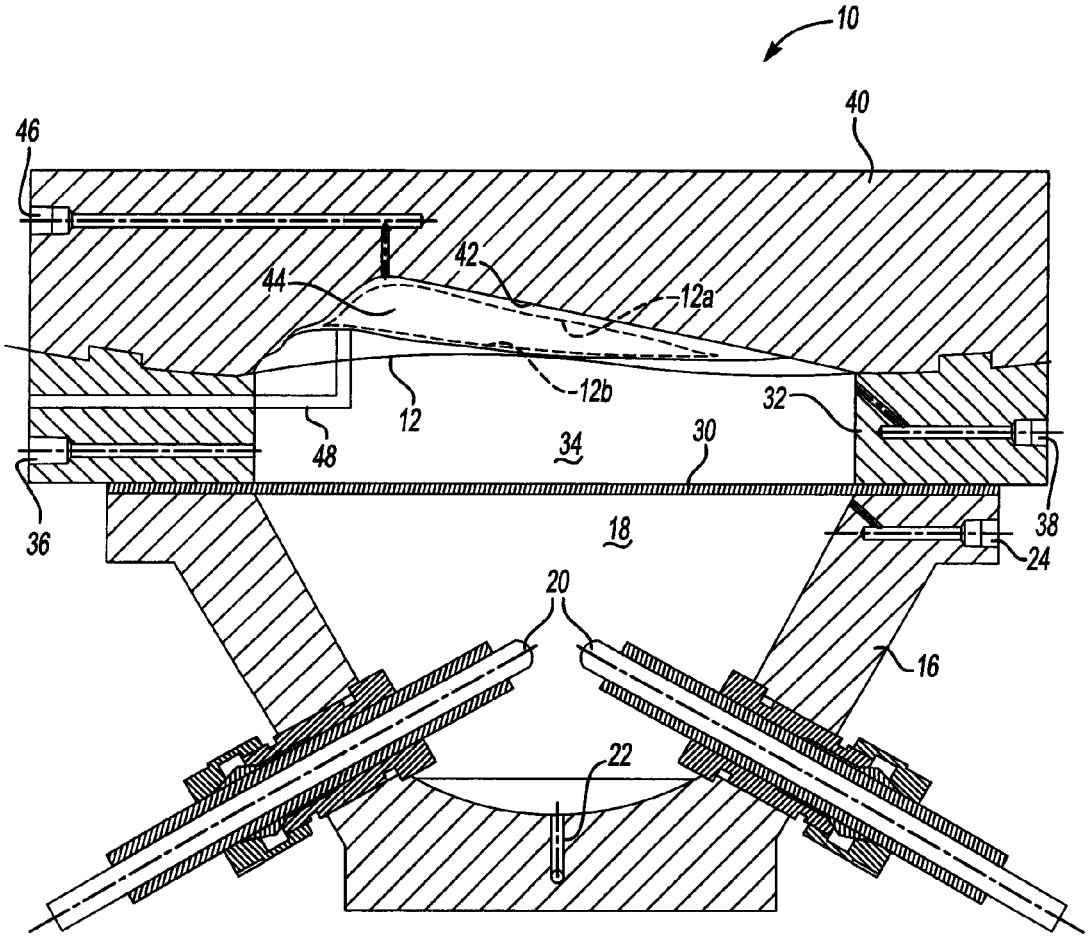
FIG. 1 is a diagrammatic cross-sectional view of an electro-hydraulic forming tool.

Referring to FIG. 1, an electro-hydraulic forming tool is generally indicated by reference numeral 10. The electro-hydraulic forming tool 10 is used to form a blank 12 of sheet metal into a desired shape.

The electro-hydraulic forming tool 10 includes a vessel 16 that defines a chamber 18. At least one pair of electrodes 20 is provided within the chamber 18. A liquid fill/drain part 22 is provided in the base of the vessel 16 through which a fluid, such as water, may be supplied or drained from the chamber 18 in the vessel 16.

An air evacuation port 24 is provided in the vessel 16 to evacuate air from the vessel 16. A membrane 30 is secured to the vessel 16 by a blank holder 32. The vessel 16 and blank holder 32 are secured together by means of conventional fasteners, as is well known in the art. The air evacuation port 24 permits removal of air or other gases that may accumulate on the bottom surface of the membrane 30 which could interfere with the operation of the electro-hydraulic forming tool 10. The blank holder 32 includes a liquid delivery channel 36 that provides a second fluid to the cavity 34 formed in the blank holder 32. An air evacuation port 38 is provided through the blank holder 32 to evacuate air from the chamber 34 immediately beneath the blank 12.

A forming die 40 is provided that has a forming surface 42 that comprises part of a die cavity 44. A die air evacuation port 46 is provided to evacuate air from the die cavity 44. An air evacuation port 48 may be provided in the blank holder 32 that is positioned with an open end at the highest point in the chamber that is below the blank. The air evacuation port 48 may be used to evacuate air from a partially formed blank if multiple high voltage discharges are required to form the blank 12 into the finished shape or if the blank was initially preformed in preliminary shape in another die.

The electro-hydraulic forming tool 10 is prepared by filling the vessel 16 with water or another suitable fluid. The membrane 30 is placed over the top of the vessel 16 to close the chamber 18. The blank holder 32 is then assembled to the vessel 16 to clamp the membrane in place. The blank 12 is then secured to the blank holder 32 and held in place by the forming die 40. The chamber 34 is then filled with a fluid, such as water, oil or another fluid, completely filling the chamber 34. Air evacuation ports 24 and 38 are used to evacuate air and to assure complete filling of chambers 18 and 34. After the electro-hydraulic forming tool 10 has been prepared as described above, a high voltage electrical pulse is provided to the electrodes 20. The pulse creates a shockwave within the chamber 18 that is propagated through the membrane 30 and the liquid in the chamber 34. The shockwave is applied to the blank 12 to cause the blank to be formed into the die cavity 44 of the forming die 40 until it contacts the forming surface 42. In some instances, it may be necessary to provide multiple high voltage electrical pulses to the electrodes to completely form the blank 12 into engagement with the forming surface 42. If multiple pulses are provided, it may be necessary to use the air evacuation port 48 to evacuate air from the partially formed blank 12*a* prior to forming the blank into its finished part shape 12*b*.

Figure 2:
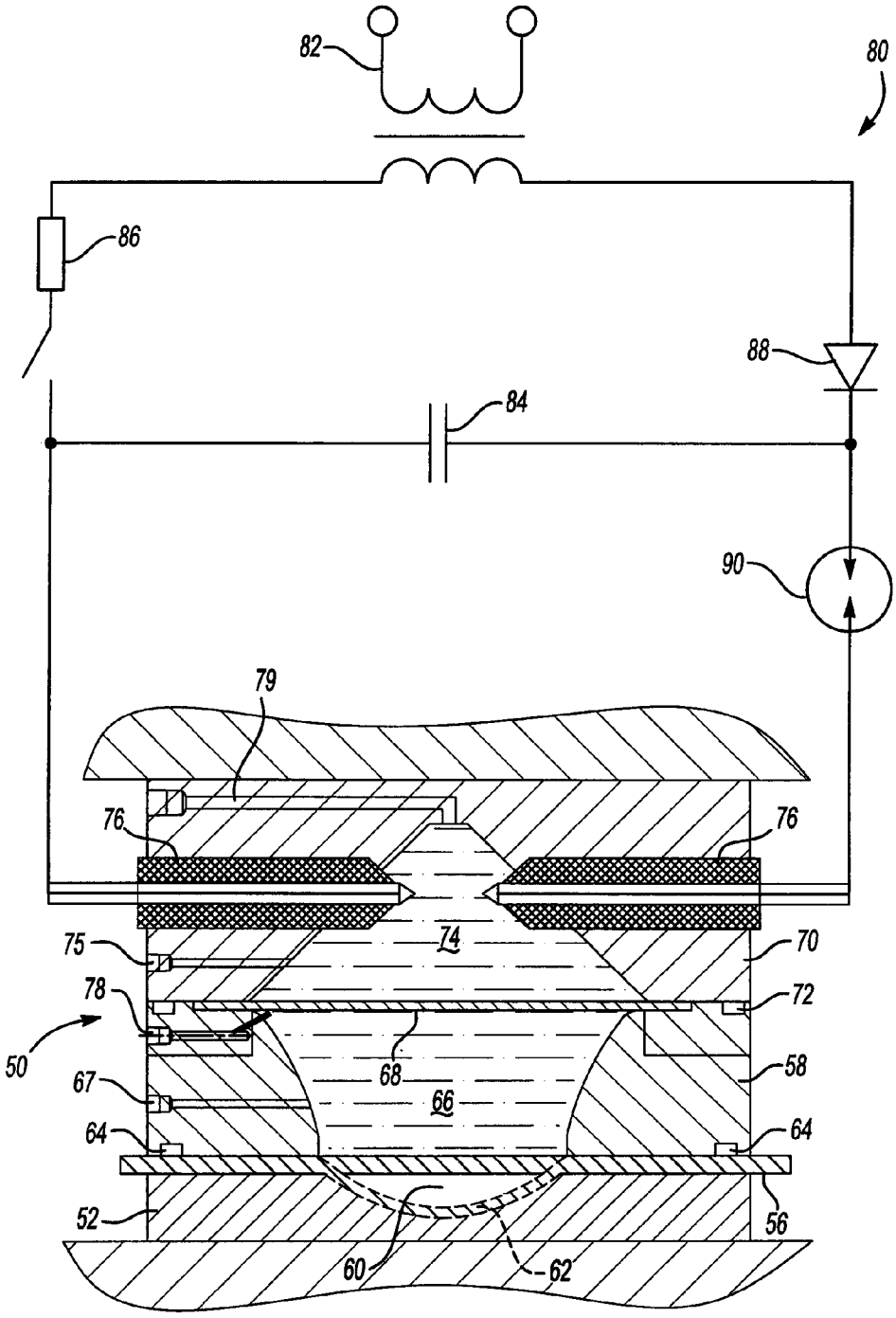
FIG. 2 is a diagrammatic cross-sectional view of an alternative embodiment of an electro-hydraulic forming tool.

Referring to FIG. 2, an alternative embodiment of an electro-hydraulic forming tool is generally indicated by reference numeral 50. Electro-hydraulic forming tool 50 includes an open one-sided die 52 into which a blank 56 is formed. The blank 56 is initially held by a blank holder 58 that holds the blank 56 over the open side of a die cavity 60. The blank 56 is formed into a formed part 62 by the electro-hydraulic forming tool 50.

A plurality of seals 64 are provided next to the blank 56 to seal between the blank and the blank holder 58. Other seals may be provided in the tool 50 to seal potential leak paths, as needed.

A lower fluid cavity 66 is defined by the blank holder 58 and the blank 56. The lower fluid cavity 66 is filled through a liquid filling port 67. Fluid may be filled and drained through a single port or may be filled and drained through separate channels. Some air pockets may be removed by the water flow by providing separate channels. A membrane 68 is secured to the blank holder 58 to enclose the lower fluid cavity 66. A vessel 70 is provided above the blank holder 58 so that the membrane 68 is retained between the blank holder 58 and the vessel 70. Seals 72 are provided outboard of the membrane 68 to seal the connection between the blank holder 58 and the vessel 70. An upper fluid cavity 74 is defined within the vessel 70. The upper fluid cavity is preferably filled with water or another fluid through a liquid filling port 75. A pair of electrodes 76 are provided within the vessel 70. The electrodes 76 are provided with a high voltage pulse that is propagated through the fluid in the upper fluid cavity 74, the membrane 68, and the lower fluid cavity 66. The shockwave is directed against the blank 56 to cause it to be formed into the die cavity 60 to form a part 62. An air evacuation port 78 may be provided to remove air from below the membrane 68. Another air evacuation port 79 may be provided in the upper fluid cavity 74.

A power circuit 80 is diagrammatically represented in FIG. 2 that is connected to electrode 76. The power circuit 80 includes a transformer 82 that is connected to a capacitor bank 84 when a charging switch 86 is closed. The capacitor bank 84 stores the charge from the transformer 82. A diode array 88 is provided to control the charging flow through the capacitor bank 84. When the capacitor bank is charged to a specified voltage, the high voltage switch 90, for example, an Ignitron switch, is closed to provide the voltage pulse to electrode 76. The voltage pulse causes the electrode 76 to arc resulting in the shockwave that is used to form the blank 56. A similar power circuit may also be provided for the electro-hydraulic forming tool 10 that is shown in FIG. 1.

Figure 3:
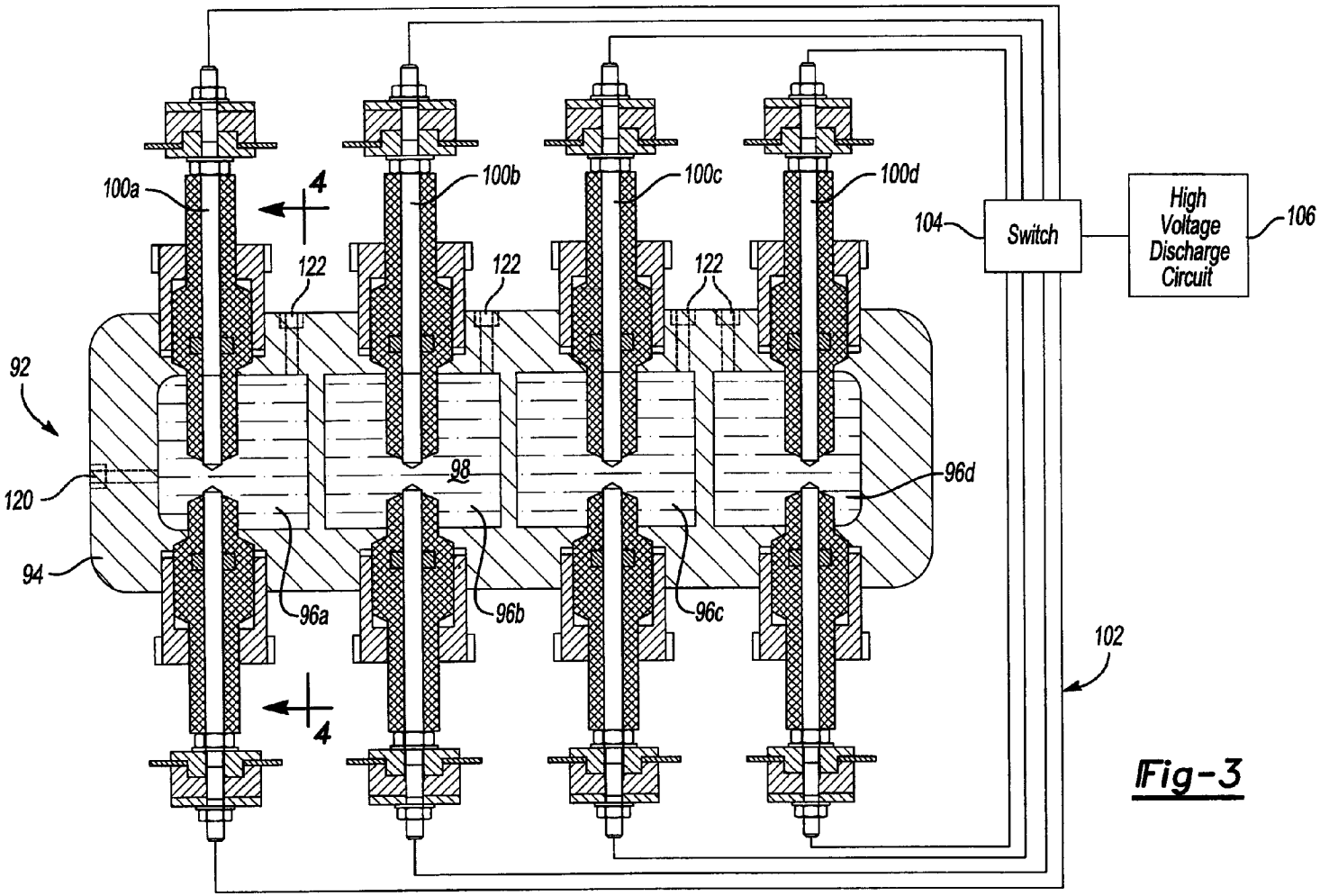
FIG. 3 is a diagrammatic cross-sectional view of an electro-hydraulic forming tool having multiple sets of electrodes in separate cells.
Figure 4:
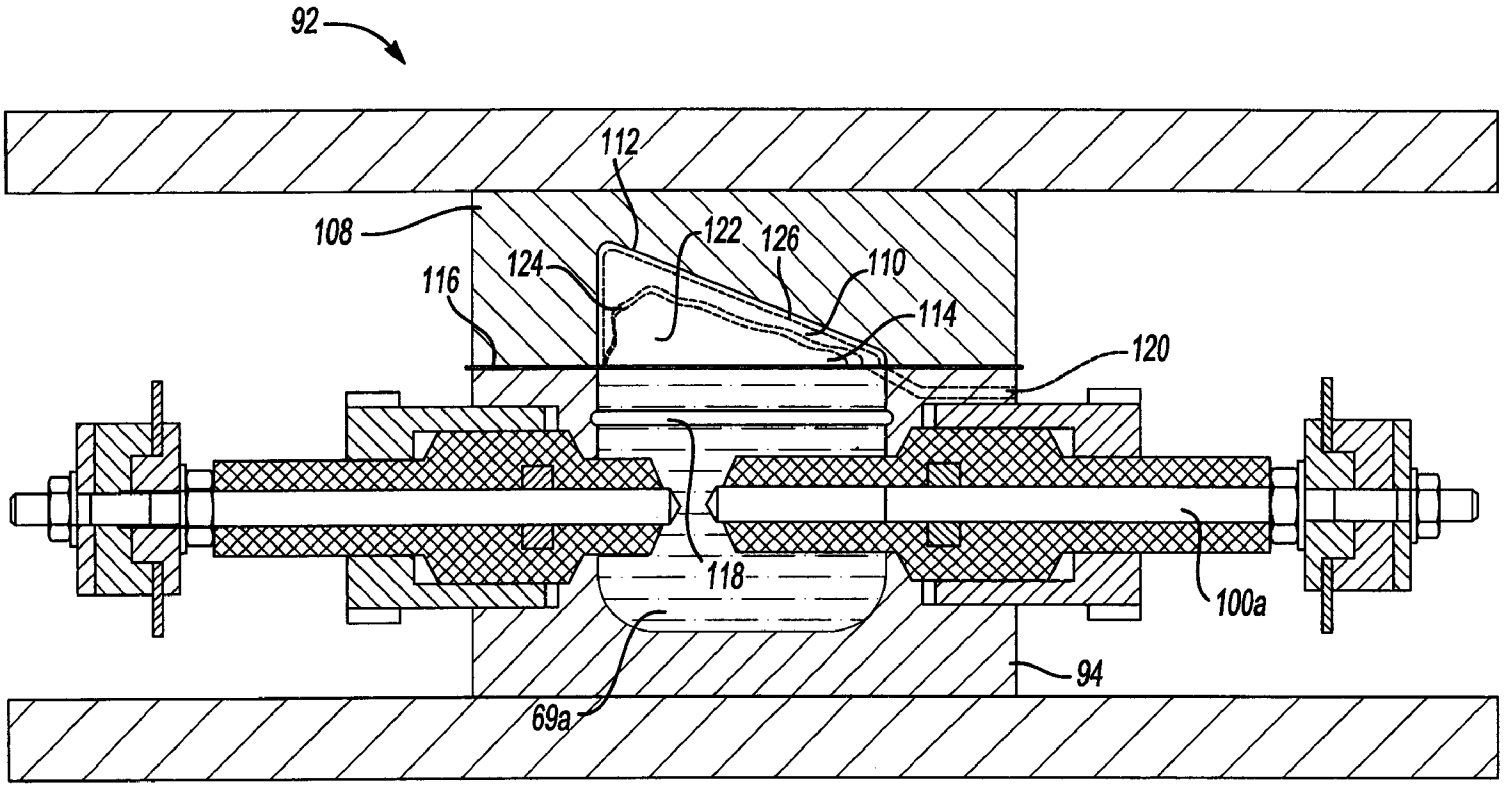
FIG. 4 is a cross-sectional view taken along line 4-4 in FIG. 3.

Referring to FIGS. 3 and 4, a multiple chamber electro-hydraulic forming tool 92 is illustrated. The multiple chamber electro-hydraulic forming tool 92 includes a vessel 94 that is divided into a plurality of cells 96*a*-96*d*. The cells 96*a*-96*d* each contain a supply of fluid 98, such as water. Each of the cells 96*a*-96*d* are provided with a pair of electrodes 100*a*-100*d*. The electrodes are connected in a circuit 102 that is diagrammatically represented in FIG. 3.

The circuit 102 includes an electrode selector switch 104 that selects a given pair of electrodes that are selectively powered by the circuit 102. A high-voltage discharge circuit 106 is connected to the electrodes 100 through the electrode selector switch 104.

The electro-hydraulic forming tool 92 includes a die 108 that defines a die cavity 110. The die cavity 110 includes a forming surface 112 against which a blank 114 is formed. The blank 114 is held in place by a binder flange 116 that is captured between the vessel 94 and the die 108. A membrane 118 may be provided within the vessel 94 that separates the fluid 98 in the vessel 94 into two fluid volumes. An initial air evacuation port 120 is provided through the vessel 94. While only one air evacuation port 120 is shown in FIGS. 3 and 4, additional ports may be provided as needed to evacuate air from the vessel 94. A partial formation air evacuation port 122 may be provided in the die to evacuate air that may collect beneath a partially formed blank. Also an additional port can be used to pump the water out of the chamber. It may provide an opportunity of continuous water flow through the chamber. As shown in FIG. 4, the blank 114 may be formed into an intermediate part 124 that is shown in phantom in FIG. 4. The electro-hydraulic forming tool may act upon the intermediate port 124 again to form the fully formed part 126.

The multiple chamber electro-hydraulic forming tool 92 may be used to form the blank 114 by selectively providing a high voltage impulse to each of the sets of electrodes 100*a*-100*d*. By providing multiple electrodes, reduced energy may be required to form a part. In addition, in accordance with the embodiment of FIGS. 3 and 4, four sets of electrodes 100*a*-100*d* are provided in the four cells 96*a*-96*d* so that four different forming pulses may be provided to the chamber. For example, the electrodes 100*b* and 100*c* may be initially energized sequentially or simultaneously to form the central portion of the blank 114 into an intermediate part 124. The high voltage discharge circuit 106 may then be used to provide a high voltage discharge to the electrodes 100*a* and 100*d* to cause the outer portions of the blank 114 to be formed resulting in the formation of the fully formed part 126. The walls between the chambers may be of adjustable height to regulate the extent of deformation of the blank. The circuit with the switch 104 can be used to switch the discharge between several chambers of dies of different shapes rather than between different electrode pairs in one multi-electrode chamber.

While the best mode for carrying out the invention has been described in detail, those familiar with the art to which this invention relates will recognize various alternative designs and embodiments for practicing the invention as defined by the following claims.

What is claimed is:

1. An electro-hydraulic forming tool for forming a sheet metal blank, the tool comprising:

a vessel defining a first cavity containing a first liquid and having at least two electrodes disposed in the first liquid, the vessel having an opening on an upper end;

a forming die disposed above the opening in the vessel, the forming die having a cavity that is partially defined by a forming surface;

a blank holder that holds the blank in engagement with the forming die;

a membrane attached to the vessel and the blank holder, wherein a second cavity is defined by the blank, the blank holder, and the membrane;

a second liquid supplied to the second cavity on top of the membrane and below the blank, the membrane separating the first liquid in the vessel from the second liquid that forms the blank; and a source of high voltage operatively connected to the two electrodes by a control circuit that selectively provides a high voltage discharge to the electrodes, wherein the high voltage discharge produces a shock wave in the first liquid that passes through the membrane and through the second liquid to form the blank against the forming surface in the cavity.

2. The electro-hydraulic forming tool of claim 1 further comprising a vessel vacuum port that opens into the vessel adjacent the opening in the vessel and is ported to a source of vacuum.

3. The electro-hydraulic forming tool of claim 1 further comprising a vacuum port that extends through the second cavity and opens into the blank holder just below the blank and is ported to a source of vacuum.

4. The electro-hydraulic forming tool of claim 1 further comprising a forming die vacuum port that opens into the forming die adjacent the top of the forming surface and is ported to a source of vacuum.

5. The electro-hydraulic forming tool of claim 1 further comprising a lower liquid supply port provided in the vessel for supplying and removing liquid from the vessel.

6. The electro-hydraulic forming tool of claim 1 further comprising an upper liquid supply port provided in the blank holder for supplying and removing liquid from the second cavity.

7. An electro-hydraulic forming tool for forming a sheet metal blank, the tool comprising:

a vessel defining a first cavity containing a first liquid and having at least two electrodes disposed in the first liquid, the vessel having an opening on a lower end;

a forming die disposed below the opening in the vessel, the forming die having a cavity that is partially defined by a forming surface;

a blank holder that holds the blank in engagement with the forming die;

a membrane attached to the vessel and the blank holder, wherein a second cavity is defined by the blank, the blank holder, and the membrane;

a second liquid supplied to the second cavity below the membrane and above the blank, the membrane separating the first liquid in the vessel from the second liquid; and a high voltage source operatively connected to the two electrodes by a control circuit that selectively discharges high voltage to the electrodes, wherein the high voltage discharge produces a shock wave in the first liquid that passes through the membrane and through the second liquid to form the blank against the forming surface in the cavity.

8. The electro-hydraulic forming tool of claim 7 further comprising a vessel vacuum port that opens into the vessel adjacent the opening in the vessel and is ported to a source of vacuum.

9. The electro-hydraulic forming tool of claim 7 wherein the control circuit has a switch for selectively switching the discharge between a plurality of chambers.

10. The electro-hydraulic forming tool of claim 7 further comprising a forming die vacuum port that opens into the forming die adjacent the top of the forming surface and is ported to a source of vacuum.

11. The electro-hydraulic forming tool of claim 7 further comprising a lower liquid supply port provided in the vessel for supplying and removing liquid from the vessel.

12. The electro-hydraulic forming tool of claim 7 further comprising an upper liquid supply port provided in the blank holder for supplying and removing liquid from the second cavity.

13. The electro-hydraulic forming tool of claim 7 wherein the first liquid is water and the second liquid is oil.

14. A method of forming a sheet metal blank in an electro-hydraulic forming tool that has a vessel defining a first cavity containing a first liquid and having at least two electrodes disposed in the first liquid, a forming die having a first cavity that is partially defined by a forming surface, a blank holder that holds the blank in engagement with the forming die, a membrane attached to the vessel and the blank holder, wherein a second cavity is defined by the blank, the blank holder, and the membrane, a second liquid supplied to the second cavity, the membrane separating the first liquid in the vessel from the second liquid in the second cavity, and a high voltage source operatively connected to the two electrodes by a control circuit, the method comprising:

providing a high voltage discharge to the electrodes;

producing a shock wave in the first liquid;

transferring the shock wave through the membrane;

passing the shock wave through the second liquid;

directing shockwave through the second liquid to the blank; and forming the blank towards the forming surface in the cavity.

15. The method of claim 14 further comprising evacuating air from the first cavity and from the second cavity and filling the first and second cavities completely with the first and second liquids.

16. The method of claim 14 further comprising providing multiple chambers in the vessel, wherein each of the chambers is provided with a pair of electrodes and wherein the step of providing a high voltage discharge is performed by sequentially providing the high voltage discharge to each of the pairs of electrodes.

17. The method of claim 14 wherein the membrane is an elastic membrane that seals the first liquid in the first cavity from the second liquid in the second cavity.

18. The method of claim 14 wherein the first liquid is a water and the second liquid is oil.

19. The method of claim 14 wherein the steps of the method are repeated at least once to form the blank fully into engagement with the forming surface.

20. The method of claim 14 wherein the second liquid is drained from the second cavity and replenished each time the method is to be performed.

* * * * *